United States Patent [19]

Arakawa et al.

[11] 4,229,631

[45] Oct. 21, 1980

[54] VACUUM-TYPE CIRCUIT BREAKER

[75] Inventors: Hideo Arakawa; Takashi Namekawa; Keiichi Kuniya; Hiroyuki Sugawara, all of Hitachi, Japan

[73] Assignee: Hitachi, Ltd., Japan

[21] Appl. No.: 922,368

[22] Filed: Jul. 6, 1978

Related U.S. Application Data

[63] Continuation of Ser. No. 626,921, Oct. 29, 1975, abandoned.

[30] Foreign Application Priority Data

Nov. 1, 1974 [JP] Japan ..... 49-126782

[51] Int. Cl.[2] ..... H01H 33/66

[52] U.S. Cl. ..... 200/144 B

[58] Field of Search ..... 200/144 B

[56] References Cited

U.S. PATENT DOCUMENTS 3,783,212 1/1974 Bates ..... 200/144 B

*Primary Examiner*—Robert S. Macon

*Attorney, Agent, or Firm*—Craig & Antonelli

[57] ABSTRACT

A vacuum-type circuit breaker comprising an evacuated container, and a pair of contacts disposed in the container and adapted to be moved between an open position and a closed position to permit a circuit breaking arc to be generated across the contacts, the contacts being made of a copper alloy containing manganese. The vacuum-type circuit breaker provided with the contacts of the aforementioned type has a higher dielectric strength than conventional vacuum-type circuit breakers.

12 Claims, 4 Drawing Figures

VACUUM-TYPE CIRCUIT BREAKER

This is a continuation of application Ser. No. 626,921 filed Oct. 29, 1975 now abandoned.

BACKGROUND OF THE INVENTION (1) Field of the Invention

This invention relates to a vacuum-type circuit breaker, and more particularly to the composition of a material for making contacts used with the circuit breaker of the type described.

(2) Description of the Prior Art

In vacuum-type circuit breakers, to increase a dielectric strength raises an important problem which will call for special efforts to solve for many years to come. If the dielectric strength of a vacuum-type circuit breaker can be increased, the voltage that can be impressed on the circuit can accordingly be increased.

The problem of increasing the dielectric strength of vacuum-type circuit breaker has hitherto had two approaches. One is through increasing the gap between the two contacts and the other relies on selecting the most suitable components and their proportions for a material for producing the contacts. Heretofore, the latter approach to the problem has generally been adopted. This is because the former approach not only makes it impossible to obtain an overall compact size and a light weight in a vacuum-type circuit breaker but also difficulty is experienced in increasing the speed at which contacts are brought into or out of engagement with each other. The latter approach is free from these disadvantages.

Generally, copper which has high conductivity is used as the main component of a material for producing contacts because it is necessary to increase the ability of the contacts to interrupt a current or to increase the value of a current that can be interrupted. Thus, in increasing the dielectric strength of contacts by selecting the most suitable components and their proportions for the material for producing the contacts, a metal or metals which are themselves effective in increasing the dielectric strength are added to copper. There has been no established theory for increasing the dielectric strength, but it is believed that, qualitatively speaking, metals of a high melting point, of low vapor pressure and of high mechanical strength have the effect of increasing the dielectric strength when added to copper. Based on this idea, a lot of alloys have been produced and tested for dielectric strength. It must be admitted, however, that only a few of the alloys tested have been successful in accomplishing the object. In this connection, it must be pointed out that impurities or gas contained in the alloys and the microstructure of the alloys exert influences on dielectric strength which are not negligible. The alloys that have been most successful in the past are copper alloys containing either iron or cobalt. These alloys have a microstructure in which the phase of iron or cobalt having a melting point and mechanical strength higher than those of copper is dispersed in the matrix of copper. By using these alloys for producing contacts, vacuum-type circuit breakers having a rated voltage of 30 KV have been manufactured. However, there is a strong demand for contacts which have a higher dielectric strength.

SUMMARY OF THE INVENTION (1) Objects of the Invention

Accordingly, an object of the invention is to provide a vacuum-type circuit breaker provided with contacts made of a material having a high dielectric strength.

Another object is to provide a vacuum-type circuit breaker provided with contacts which have a higher dielectric strength than contacts made of a copper alloy containing iron or cobalt.

(2) Statement of the Invention

The invention resides in the use of a copper alloy containing manganese for producing a pair of contacts of a vacuum-type circuit breaker comprising an evacuated container in which the pair of contacts are disposed for movement between an open position and a closed position to generate a circuit breaker arc when moved to the open position. It has been ascertained, by conducting dielectric strength tests on various types of copper alloys without sticking to the conventional way of attacking the problem qualitatively, that the copper-manganese alloy has a high dielectric strength. Since manganese has a higher vapor pressure than copper, the result obtained might be said to be contrary to the result obtained by attacking the problem based on the qualitative idea in the conventional manner.

The dielectric strength of the contacts made of a copper-manganese alloy has markedly increased when the proportion of manganese in the alloy was 2% by weight or over. However, the upper limit of the amount of manganese in the alloy has been found to be 50% by weight when other requirements for the contacts of a vacuum-type circuit breaker than a dielectric strength, e.g. the current interrupting ability, were taken into consideration. The best result has been achieved when the proportion of manganese was from 2 to 50% by weight. It is presumed that the reason why the copper-manganese alloys in which the proportion of manganese is in a range between 2 and 25% by weight have a particularly high dielectric strength is because the components of the alloys containing manganese in these proportions are completely soluble in each other in a solid state to provide a substantially uniform copper-manganese solid solution at normal temperature, with the manganese vaporizing in a stable manner. However, the contacts made of alloys in the form of a copper-manganese solid solution have been found to have the following defect. That is, the contacts have a high dielectric strength in initial stages of their use when the number of times of the circuit breaker operation is small, but their dielectric strength shows a reduction as the number of times of the circuit breaking operation increases. This means that the contacts have a short service life and consequently the vacuum interrupter must be replaced by a new one in a short time interval.

Thus, it is urgently required to eliminate this defect by further improving the material for making the contacts, so that an investigation was carried out to find out the cause of this defect. As the result of the investigation, it has been ascertained that interruption of the current causes a variation in the amount of manganese in the surface layers of the contacts. More specifically, it has been found that an arc generated across the contact when the current is interrupted causes a difference in the local concentration of manganese in the surface layers of the contacts, and the amount of manganese shows a marked reduction after the circuit breaking operation has been performed a lot of times. This phenomenon could be explained as follows: the surfaces of the contacts melted by the arc would be quenched and subjected to non-equilibrium solidification, thereby giving rise to a phase rich in copper and a phase rich in manganese. Moreover, since manganese has a high vapor pressure, the manganese present in portions of the contacts where the arc is generated would vaporize and the amount of manganese which vaporizes would increase with an increase in the number of times of the circuit breaking operation. In view of this analysis, it was decided that another metal should be added to the copper alloy used for making the contacts and the surface conditions of the contacts were examined after performing a series of circuit breaking operations.

As the result of this examination, it has been established that the addition of a metal having a higher boiling point than manganese is capable of avoiding vaporization of manganese and preventing a reduction in dielectric strength which would otherwise be caused by vaporization of manganese with an increase in the number of times of the circuit breaking operation. Metals having a higher boiling point than manganese include aluminum, silicon, cobalt, nickel, titanium, chromium and zirconium. In practice, at least one metal selected from the group consisting of the aforementioned metals is added to the copper-manganese alloy.

Although any of these metals becomes increasingly effective in suppressing vaporization of manganese as its proportion in the alloy is increased, the proportion of such metal plus manganese in the alloy should not exceed 50% by weight. A preferred composition of the alloy comprising a metal of a higher boiling point than manganese is 50% by weight or less of such metal plus manganese and the balance substantially copper, the proportion of manganese being 2 to 25% by weight.

The aforementioned metals having a higher boiling point than manganese can be broadly classified into those which form compounds with manganese and those which do not. The results of experiments conducted for dielectric strength on the contacts made of a copper-manganese alloy containing a metal which forms a compound with manganese and contacts made of a copper-manganese alloy containing a metal which does not form a compound with manganese show that the former have a higher dielectric strength. It is also shown that the contacts made of the former alloy have a higher dielectric strength than a binary alloy of copper and manganese in initial stages of the circuit breaking operation. It will be seen that preferably the metal having a higher boiling point than manganese be selected from the group of metals each of which forms a compound with manganese.

A compound of manganese produced in this way is in the form of a ternary alloy of copper, manganese and a metal forming a compound with manganese. There is no established theory for the process of production of such compound and generally the production is carried out empirically. A composite compound of manganese containing copper may be produced depending on the type of metal added to the alloy. Contacts made of such alloy have an increased dielectric strength so long as manganese is contained in the alloy.

Addition of a metal forming a compound with manganese will have effect in increasing dielectric strength if its amount is sufficiently high to fix a portion of the manganese in the alloys as a manganese compound. Preferably, the amount of such metal should be sufficiently high to fix the major part of or all the manganese as a manganese compound. If this is the case, the minimum proportion of manganese is 2% by weight and the proportion of manganese plus a metal forming a compound with manganese is 50% by weight or less. Of all the metals having a higher boiling point than manganese as aforementioned, aluminum, silicon, zirconium, nickel, titanium and chromium each form a compound with manganese. In actual practice, the metal to be added to the copper-manganese alloy is selected from this group of metals. It is to be noted that silicon and zirconium can achieve excellent results when added to the alloy. The invention will be described in detail with reference to the addition of silicon. It is to be understood, however, that the use of this metal is for illustration only and not limiting in nature.

Addition of manganese and silicon to copper results in the silicon and manganese forming a silicide of manganese which is dispersed in the matrix of copper. The silicide of manganese may be $Mn_5Si_3$, $Mn_3Si$, MnSi or $MnSi_2$, the form of the silicide of manganese varying depending on the weight ratio of manganese to silicon. It has been ascertained that the silicide of manganese in the form of $Mn_5Si_3$ is particularly effective in increasing the dielectric strength of contacts. As an example, the contacts made of a copper alloy containing 25% by weight $Mn_5Si_3$ were tested for dielectric strength. It has been revealed that such contacts have a high dielectric strength of an average of 120 KV under the following testing conditions: the interrupted current, 360 A; the gap between the contacts, 2.5 mm; and the number of times of the circuit breaking operation, 100. This value is more than twice the value obtained with contacts made of a copper alloy containing 20 to 30% by weight cobalt. It has also been revealed that no reduction in dielectric strength was caused by further repetition of the circuit breaking operation.

$Mn_5Si_3$ is produced in the form of 23.48 weight % silicon 76.52 weight % manganese. In this compound the weight ratio of silicon to manganese is about 1:3.26, so that it follows that the alloy has only to contain 1% by weight silicon for 3.26% by weight manganese. A further study of $Mn_5Si_3$ has revealed that its proportion in the alloy is preferably 50% by weight or less. A small proportion (about 4% by weight) of $Mn_5Si_3$ is soluble in copper in a solid state, and the alloy should contain $Mn_5Si_3$ in a proportion which is higher than the limit of proportion in which it is soluble in copper in a solid state. Accordingly, a preferred proportion of manganese when it exists in the form of $Mn_5Si_3$ will be substantially in a range between 3.1 and 38.3% by weight when calculated in terms of $Mn_5Si_3$ in a proportion of 4 to 50% by weight. Silicon with be in a range between 0.9 and 11.7% by weight.

The contacts according to the invention which are made of a copper-manganese alloy system may also be added with at least one of the group of metals consisting of lead, bismuth, tellurium and antimony which is generally added to the alloy for the purposes of increasing non-welding characteristic and improving the value of a chopping current. The proportion of any of such metals added to the alloy is preferably less than 5% by weight in order to prevent a reduction in the dielectric strength of the contacts. Even in cases where any one of the aforementioned metals is added, the proportion of copper in the alloy should not be less than 50% by weight.

DESCRIPTION OF PREFERRED EMBODIMENTS

Figure 1:
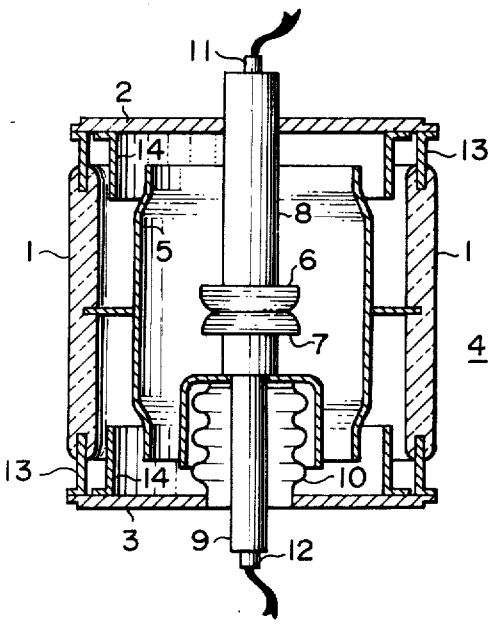
FIG. 1 is a sectional view of a vacuum-type circuit breaker.

The construction of a vacuum-type circuit breaker wherein contacts made of the alloy according to the invention is shown for illustrative purpose in FIG. 1. The circuit breaker has a container 4 comprising a case 1 made of an electrically insulating material and a pair of metal end caps 2 and 3 for closing both ends of the case 1. The pressure within the container 4 is maintained generally lower than $10^{-4}$ Torr and preferably within the range of $10^{-5}$ to $10^{-8}$ Torr in non-operating and reposing condition of the circuit breaker. The inner wall surface of the case 1 is covered with a shield tube 5 suitably supported by the case 1 for preventing metal vapor generated by the arc from adhering to and solidifying on the inner wall surface of the case 1. The shield tube 5 is adapted to shield the case 1 from the vapor generated by the arc before the vapor reaches the case 1.

A pair of electrodes or contacts, i.e. an upper contact 6 and a lower contact 7, are provided in the container 4.

The upper contact 6 is fixedly secured to a stationary conductive bar 8 which in turn is fixedly mounted on the metal end cap 2. The lower contact 7 is mounted on a movable conductive bar 9 so as to be movable.

The movable conductive bar 9 extends through an opening provided in the metal end cap 3. A metal bellows 10 is provided circumferentially around the movable conductive bar 9. The metal bellows 10 is adapted to permit the movable conductive bar 9 to move longitudinally without breaking vacuum in the container 4. A suitable actuating device (not shown) is provided beneath the movable conductive bar 9 for opening the circuit breaker by downwardly moving the lower contact 7 away from the upper contact 6, and closing the circuit breaker by returning the lower contact 7 to the position shown in the drawing.

Further, terminals designated at 11 and 12 are provided to connect the circuit breaker to an A.C. power circuit. The upper terminal 11 is connected to the upper contact 6 through the stationary conductive bar 8. The lower terminal 12 is connected to the lower contact 7 through the movable conductive bar 9. When the circuit breaker is closed as shown in FIG. 1, a current flows between the terminals through the upper and lower contacts.

The case 1 made of an insulating material and the metal end caps 2 and 3 are joined generally by inert gas-tungsten arc welding or soldering.

However, the case is generally made of ceramic or glass, and the metal end caps 2 and 3 are made of copper. Consequently, if both are directly joined, cracking may be caused by the case 1 due to the excessively great difference in coefficient of thermal expansion between the case and the metal end caps.

Accordingly fittings 13 made of a material having a coefficient of thermal expansion between those of the case 1 and the metal end caps 2 and 3 are buried into both ends of the case 1, and the fittings 13 are joined to the metal end caps 2 and 3.

When the case 1 is made of glass and the metal end caps 2 and 3 are made of copper, the fittings 13 are generally made of fernico.

Usually metal vapor generated by the arc is shielded before reaching the inner wall surface of the case 1. However, part of vaporized metal having escaped from shielding, passes through an aperture formed between the end of the shield tube 5 and the metal end case 2 and 3, enters the rear side of the shield tube 5, and may adhere to the inner wall surface of the case 1. To prevent this, end shield tubes 14 are provided in the intermediate positions between the case 1 and the shield tube in most cases.

The upper contact 6 and the lower contact 7 juxtaposed against each other is made of a copper base alloy containing manganese. The upper contact 6 is joined by brazing to the fixed conductive bar 8, while the lower contact 7 is joined by brazing to the movable conductive bar 9. Brazing is generally carried out at a temperature above 600° C. Upon completion of assembling of various parts, the circuit breaker is subjected to degassing to remove gas which may be adhering to the inner wall surface of the case or various parts in the container. Degassing is generally performed at a temperature about 400° C. After being treated in this way, the vacuum-type circuit breaker is put to use.

EXAMPLE 1

A copper based binary alloy comprising 10% by weight manganese was produced. In producing the alloy, oxygen-free copper and a copper-manganese mother alloy were used as raw materials which were melted in a vacuum atmosphere of $5\times10^{-5}$ Torr by using a crucible made of alumina. After ascertaining that the raw materials had been completely melted, the molten alloy was cast in a mold at a casting temperature ranging from 1100° C. to 1200° C. Specimens were obtained from the ingot produced and tested for dielectric strength. In performing the dielectric strength tests, the specimens were tested for dielectric breakdown voltage under the following conditions by using a vacuum-type circuit breaker of the assembly type: After interrupting a current of 360 A 10 times, impulses voltage were impressed stepwise at intervals of 5 to 10 KV on the circuit breaker by setting the gap between the contacts at 2.5 mm and discharge voltages were determined. The alloy had a dielectric strength of 90 KV in initial stages after the circuit breaking operation was performed 10 times, and the dielectric strength was in a range between 25 and 45 KV after having performed the circit breaking operation 100 times.

Contacts made of a copper base binary alloy containing 20% by weight cobalt of the prior art had a dielectric strength of 55 KV on an average under the same conditions, the maximum value being 70 KV. It will be appreciated that the contacts made of aforementioned copper-manganese binary alloy are superior to those made of the conventional alloy in dielectric strength in initial stages of operation.

EXAMPLE 2

A copper base ternary alloy comprising 5% by weight manganese and 20% by weight cobalt was produced and tested for dielectric strength. The alloy was produced and the tests were performed in the same manner as described with reference to Example 1. As a result, the alloy had a dielectric strength in a range between 50 and 80 KV or of an average of 65 KV after the circuit breaking operation was performed 100 times. It will be seen that the value obtained is higher than that for the conventional copper base binary alloy containing 20% by weight cobalt.

EXAMPLE 3

A copper base ternary alloy containing 12% by weight manganese and 8% by weight aluminum was produced. The alloy was produced and the tests were performed in the same manner as described with reference to Example 1. This alloy has a microstructure in which a composite manganese compound of copper, manganese and aluminum is dispersed in the copper matrix. The alloy had an average dielectric strength of 70 KV before the circuit breaking operation was performed 100 times.

EXAMPLE 4

A copper base ternary alloy containing 25% by weight manganese and 12% by weight titanium was produced and tested for dielectric strength. The conditions under which the alloy was produced were same as those under which the alloy of Example 1 was produced except for the fact that the casting temperature in this example was about 1400° C. The alloy of this example had a dielectric strength of 70 KV on an average under the test conditions same as those for the alloy of Example 1.

EXAMPLE 5

A copper base ternary alloy containing manganese and silicon was produced. In producing the alloy, oxygen-free copper, a copper-manganese mother alloy and a copper-silicon mother alloy were used as raw materials and the production was carried out under the same conditions as described with reference to Example 1.

Figure 2:
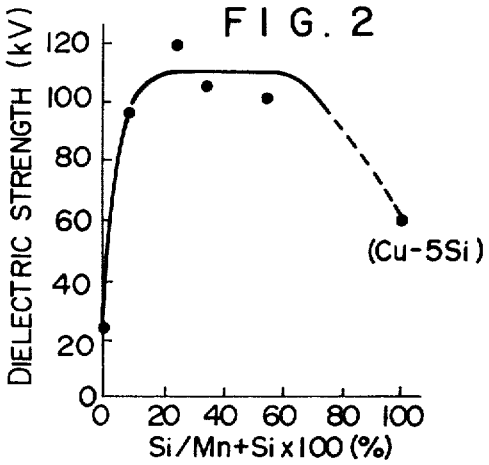
FIG. 2 is a characteristic curve diagram showing the dielectric strength of contacts made of a ternary alloy of copper, manganese and silicon in relation to the weight ratio of silicon to manganese plus silicon.

As one example of this type of alloy, a specimen containing 25% by weight copper and $Mn_5Si_3$ was tested for dielectric strength under the same testing conditions as described with reference to Example 1. The results show that the specimen had a dielectric strength of about 150 KV in initial stages of tests when the circuit breaking operation was performed 10 times, and the dielectric strength had become 90 to 150 KV, with an average of 120 KV, before the circuit breaking operation was performed 100 times. Experiments were conducted to determine an average dielectric strength of the copper-manganese-silicon alloy for the weight ratio of silicon to manganese in the alloy under the same conditions as described with reference to Example 2. The results are shown in FIG. 2. As the results of experiments, it has been ascertained that, when the ratio of silicon/manganese plus silicon in weight % is about 5/100–50/100, this alloy has a higher dielectric strength than the conventional copper alloy comprising 20 to 30% by weight cobalt. The alloy wherein its components are in this favorable range has a microstructure in which a silicide of manganese is dispersed and scattered in the copper matrix.

Figure 3:
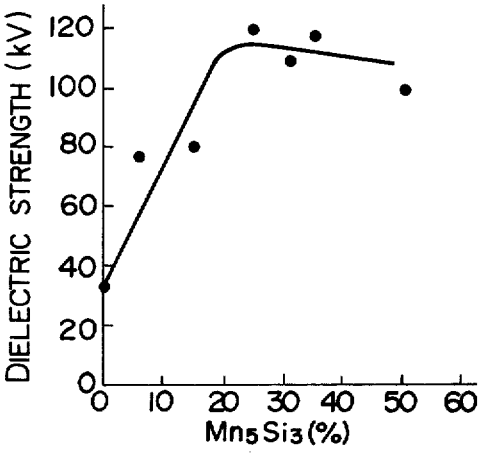
FIG. 3 is a characteristic curve diagram showing the dielectric strength contacts made of copper alloys in which $Mn_5Si_3$ is formed in the copper matrix, in relation to the proportion of $Mn_5Si_3$.

Then, tests were performed to determine the relation between the content of $Mn_5Si_3$ in the copper-$Mn_5Si_3$ alloy and the dielectric strength. The tests were performed under the same conditions as described with reference to Example 1. The average dielectric strength obtained before the number of times of the circuit breaking operation has reached 100 is shown in relation to the weight % of $Mn_5Si_3$ by a curve in FIG. 3. It will be seen that the dielectric strength is markedly improved when the content of $Mn_5Si_3$ is about 5 weight %. It is presumed that this is the maximum amount of $Mn_5Si_3$ soluble in solid state in the copper matrix as seen in the microstructure. Thus it has been clearly shown that the presence of the silicide of manganese in the copper matrix is of importance.

The dielectric strength was maximized when the content of $Mn_5Si_3$ was 25% by weight. The presence of $Mn_5Si_3$ in an amount greater than 25% by weight brought about no marked improvement in the dielectric strength. The alloy containing 50% by weight $Mn_5Si_3$ has a higher dielectric strength than the conventional copper-cobalt alloy. However, the presence of this compound in an amount greater than 50% by weight might adversely affect the mechanical strength and other properties of the alloy. Thus it is desirable that the content of $Mn_5Si_3$ be limited to 50% by weight.

Figure 4:
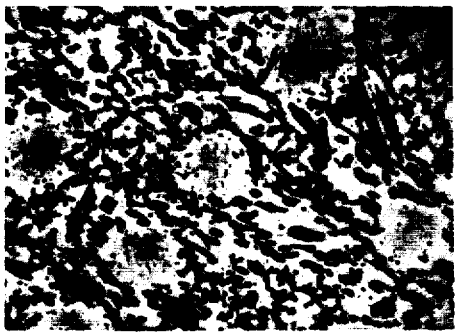
FIG. 4 is a photograph showing the microstructure of an alloy material which contains 25% by weight $Mn_5Si_3$ dispersed in copper.

FIG. 4 is a photo showing the microscopic structure (magnification: 400×) of the copper-25% by weight $Mn_5Si_3$ alloy. It will be seen that the principal component of the matrix is copper, with manganese and silicon being dissolved therein in a solid state in amounts less than the solid solution limit. The gray colored phase represents $Mn_5Si_3$ which is dispersed substantially uniformly throughout the entire matrix.

EXAMPLE 6

An alloy containing a lead-bismuth alloy added to a copper-25% by weight $Mn_5Si_3$ alloy was produced.

In producing this alloy, the same raw materials as described with reference to Example 5 were used, and after it has been ascertained that the raw materials had been completely melted in a vacuum atmosphere, the atmosphere was switched to an argon gas atmosphere and the lead-bismuth alloy of a predetermined composition was added to the molten alloy to produce a copper-25% by weight $Mn_5Si_3$ alloy containing low melting point metals. Tests were performed to determine the dielectric strength, chopping current and non-welding characteristic of this alloy.

The tests for dielectric strength were performed under the same conditions as described with reference to Example 1, and the chopping current value was determined under conditions of 60 KV and 2 to 10 A. The method of tests for non-welding characteristic consisted in comparison of the alloy with the conventional copper-20% by weight cobalt alloy. This is, a current of 360 A was passed to the specimens to compare their non-welding characteristic. The results of the tests are shown in Table 1 below. For the sake of comparison, the properties of a copper-25% by weight $Mn_5Si_3$ alloy containing no low melting point metals and a copper-20% by weight cobalt alloy are shown.

TABLE 1

| No. | Alloy (Weight %) | Dielectric strength (KV) | Chopping current (A) | Non-welding characteristic |
|---|---|---|---|---|
| 1 | Cu-25 $Mn_5Si_3$ | 120 | 6.5 | Fairly good |

TABLE 1-continued

| No. | Alloy (Weight %) | Dielectric strength (KV) | Chopping current (A) | Non-welding characteristic |
|---|---|---|---|---|
| 2 | Cu-25 $Mn_5Si_3$-5 5 PbBi | 75 | 2.8 | Good |
| 3 | Cu-20 Co | 55 | 8.0 | — |

From the results of tests shown in Table 1, it has been ascertained that addition of the lead-bismuth alloy to the copper-manganese-silicon alloy has the effect of improving the chopping current value while the alloy is satisfactory in its non-welding characteristic. This is attributed to the fact that the lead-bismuth alloy is not almost entirely soluble in the matrix in a solid state and present on the surfaces of the contacts, with the results that the bonding strength is decreased and suitable amounts of low melting point elements vaporize between the contacts when a circuit breaking operation is performed, thereby producing favorable results.

It is to be noted that, although the dielectric strength of the copper-manganese-silicon alloy is slightly reduced by the addition of low melting point elements adapted to lower the chopping current value, the alloy still has a higher dielectric strength than the conventional copper-cobalt alloy.

EXAMPLE 7

A copper base ternary alloy containing manganese and zirconium and a copper base ternary alloy containing manganese and zirconium and added with a lead-bismuth alloy were produced by the same method as described with reference to Example 6. The alloys were tested for dielectric strength, chopping current value and non-welding characteristic. The results of tests are shown in Table 2.

TABLE 2

| No. | Alloy (Weight %) | Dielectric strength (KV) | Chopping current (A) | Non-welding characteristic |
|---|---|---|---|---|
| 4 | Cu-2.5 Mn-4.5 Zr | 83 | 5.8 | Fairly good |
| 5 | Cu-5.5 Mn-4.5 Zr | 86 | 5.8 | Fairly good |
| 6 | Cu-2.5 Mn-4.5 Zr-0.5 PbBi | 78 | 5.7 | Good |

It will be appreciated from the table that the copper-manganese-zirconium alloy has a high dielectric strength too. In the tests, the contact has a gap of 2.5 mm therebetween.

As described in detail with reference to the various examples, it has been ascertained that the contacts of a vacuum-type circuit breaker made of a copper alloy containing manganese have a much higher dielectric strength than contacts made of conventional alloys. It has also been ascertained that, by causing the manganese to be dispersed and scattered in the form of a manganese compound in the copper matrix, the action of the manganese in the alloy can be markedly increased.

We claim:

1. A vacuum-type circuit breaker comprising an evacuated container, and a pair of contacts disposed in said container and adapted to be moved between an open position and a closed position to permit a circuit breaking arc to be generated across the contacts, said contacts consisting substantially of a copper alloy which is cast from a melt, said alloy containing an intermetallic compound of manganese and a metal selected from the group consisting of aluminum, silicon, zirconium, nickel, titanium and chromium, such that said contacts have a high initial dielectric strength, which dielectric strength is not substantially reduced as said contacts are repeatedly moved between an open position and a closed position to permit a circuit breaking arc to be generated across the contacts.

2. A vacuum-type circuit breaker as claimed in claim 1, wherein the proportion of said compound is 50% by weight or less, the proportion of manganese being 2% by weight or over.

3. A vacuum-type circuit breaker as claimed in claim 1, wherein said copper alloy contains 50% by weight or less manganese plus silicon, the proportion of manganese being 2% by weight or over.

4. A vacuum-type circuit breaker as claimed in claim 1, wherein said contacts consist substantially of a copper-manganese-silicon alloy, the manganese and the silicon forming $Mn_5Si_3$ which is 4 to 50% by weight in proportion.

5. A vacuum-type circuit breaker as claimed in claim 1, wherein said copper alloy contains 50% by weight or less manganese plus zirconium, the proportion of manganese being 2% by weight or over.

6. A vacuum-type circuit breaker according to claim 1, wherein said manganese and said metal are present in said copper alloy as a solid solution.

7. A vacuum-type circuit breaker according to claim 1, wherein said copper alloy further contains a metal having a property for enhancing the value of chopping current, said metal consisting of at least one of lead, bismuth, tellurium and antimony, and being present in an amount less than 5% by weight.

8. A vacuum-type circuit breaker as claimed in claim 7, wherein the amount of said metal is sufficiently high that at least a major part of the manganese is fixed as a manganese compound.

9. A vacuum-type circuit breaker as claimed in claim 8, wherein said metal is silicon, said silicon is in the form of a compound with manganese, and said compound is a silicide of manganese.

10. A vacuum-type circuit breaker as claimed in claim 9, wherein said silicide of manganese is selected from the group consisting of $Mn_5Si_3$, $Mn_3Si$, MnSi, and $MnSi_2$.

11. A vacuum-type circuit breaker as claimed in claim 9, wherein the amount of silicon is sufficiently high that all of the manganese is fixed as a manganese compound.

12. A vacuum-type circuit breaker as claimed in claim 8, wherein the amount of said metal is sufficiently high that all of the manganese is fixed as a manganese compound.

* * * * *